US012359660B2

(12) United States Patent
Kumar et al.

(10) Patent No.: US 12,359,660 B2
(45) Date of Patent: Jul. 15, 2025

(54) LINEAR FRAC PUMP DRIVE SYSTEM SAFETY DEFLECTOR

(71) Applicant: SPM Oil & Gas Inc., Fort Worth, TX (US)

(72) Inventors: Chandu Kumar, Fort Worth, TX (US); John McCrady, Burleson, TX (US); Joe Allen Sutton, Weatherford, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 141 days.

(21) Appl. No.: 17/905,462

(22) PCT Filed: Mar. 2, 2021

(86) PCT No.: PCT/US2021/020548
§ 371 (c)(1),
(2) Date: Sep. 1, 2022

(87) PCT Pub. No.: WO2021/178455
PCT Pub. Date: Sep. 10, 2021

(65) Prior Publication Data

US 2023/0142942 A1 May 11, 2023

Related U.S. Application Data

(60) Provisional application No. 62/984,145, filed on Mar. 2, 2020.

(51) Int. Cl.
*F04B 47/00* (2006.01)
*F04B 53/00* (2006.01)

(52) U.S. Cl.
CPC ..... *F04B 47/00* (2013.01); *F04B 53/00* (2013.01)

(58) Field of Classification Search
CPC ..... F04B 9/113; F04B 5/02; F04B 1/0443; F04B 53/02; F04B 53/04; F04B 53/06; F04B 53/16
(Continued)

(56) References Cited

U.S. PATENT DOCUMENTS 123,659 A * 2/1872 Allen ..... F04B 17/05 417/397
157,617 A * 12/1874 Loretz ..... F04B 9/113 417/397
(Continued)

OTHER PUBLICATIONS

International Search Report and Written Opinion issued in Application No. PCT/US2021/020548; Dated May 13, 2021, 8 Pages.

*Primary Examiner* — Charles G Freay
*Assistant Examiner* — Benjamin Doyle
(74) *Attorney, Agent, or Firm* — Foley & Lardner LLP

(57) ABSTRACT

A linear pump includes a centrally-disposed drive system and a plunger having a center portion coupled to the drive system, and first and second fluid ends disposed at the first and second ends of the plunger. The pump further includes first and second packing seals each being disposed about the plunger to isolate fluids within the respective first and second fluid ends. First and second adapters are disposed at an interface between the drive system and respective first and second fluid ends, each adapter incorporating an angled deflector configured to deflect and redirect high-pressure fluids escaping past the respective packing seal toward the drive system.

20 Claims, 3 Drawing Sheets

(58) Field of Classification Search
USPC ..... 417/397, 215
See application file for complete search history.

(56) References Cited

U.S. PATENT DOCUMENTS 1,900,437 A * 3/1933 Durham ..... F16J 15/28 277/514
2,169,703 A * 8/1939 Mason ..... F04B 9/1172 417/397
2,219,064 A * 10/1940 Boyer ..... F16J 15/187 277/504
2,296,647 A * 9/1942 McCormick ..... F04B 9/10 91/308
2,970,546 A * 2/1961 White ..... F01L 25/08 92/162 R
2,991,003 A * 7/1961 Petersen ..... F04B 39/042 417/267
3,022,738 A * 2/1962 Everett ..... F01L 33/02 91/39
3,070,023 A * 12/1962 Glasgow ..... F01L 23/00 91/305
3,143,075 A * 8/1964 Giroux ..... F04B 5/00 417/521
3,183,840 A * 5/1965 Conover ..... F01L 25/063 91/308
3,282,167 A * 11/1966 McKenzie ..... F15B 3/00 417/397
3,440,967 A * 4/1969 Joseph ..... F04B 5/00 417/397
3,650,638 A * 3/1972 Cole ..... F01L 23/00 417/900
3,776,558 A * 12/1973 Maurer ..... F16J 15/008 277/914
3,967,542 A * 7/1976 Hall ..... F04B 1/02 417/454
3,972,396 A * 8/1976 Bochnak ..... B64C 27/51 188/312
4,276,003 A * 6/1981 Perkins ..... F04B 9/02 417/415
4,373,874 A * 2/1983 Phillips ..... F04B 9/115 91/40
4,500,267 A * 2/1985 Birdwell ..... F04B 53/125 91/39
4,526,520 A * 7/1985 Henderson ..... F04B 9/14 417/559
4,541,779 A * 9/1985 Birdwell ..... F04B 15/02 417/454
4,606,709 A * 8/1986 Chisolm ..... F04B 9/1172 417/397
4,653,986 A * 3/1987 Ashton ..... F04B 9/113 417/268
4,659,294 A * 4/1987 Barthomeuf ..... F03C 1/0073 91/320
4,676,724 A * 6/1987 Birdwell ..... F04B 9/111 417/342
4,730,991 A * 3/1988 Handfield ..... F04B 9/133 417/397
4,818,191 A * 4/1989 Schlake ..... F04B 9/113 91/275
4,962,937 A 10/1990 Ashenfelder, Jr.
6,079,959 A * 6/2000 Kingsford ..... F04B 53/164 417/393
8,449,265 B2 * 5/2013 Marica ..... F04B 15/02 417/215
11,009,016 B2 * 5/2021 Davids ..... F04B 19/22
11,761,317 B2 * 9/2023 Stephenson ..... F04B 15/02 417/44.2
2003/0099556 A1 * 5/2003 Hansen ..... F04B 9/113 417/397
2011/0197757 A1 * 8/2011 Hold ..... F16J 15/26 92/168
2014/0015202 A1 * 1/2014 Chacko ..... F04B 1/0448 277/500
2015/0192117 A1 * 7/2015 Bridges ..... F04B 9/111 417/364
2016/0131131 A1 * 5/2016 Weaver ..... F04B 53/164 277/300
2016/0298614 A1 * 10/2016 Gaillard ..... F04B 9/113
2017/0227001 A1 8/2017 Wrobel et al.
2018/0135606 A1 * 5/2018 Oklejas, Jr. ..... F04F 13/00
2022/0243708 A1 * 8/2022 Bridges ..... F04B 9/113

* cited by examiner

LINEAR FRAC PUMP DRIVE SYSTEM SAFETY DEFLECTOR

CROSS-REFERENCE TO RELATED APPLICATIONS

This Patent Application is a 371 national stage of PCT Application No. PCT/US2021/020548 filed on Mar. 2, 2021, entitled "LINEAR FRAC PUMP DRIVE SYSTEM SAFETY DEFLECTOR," which claims priority to U.S. Provisional Application No. 62/984,145, filed on Mar. 2, 2020, entitled "LINEAR FRAC PUMP DRIVE SYSTEM SAFETY DEFLECTOR," and assigned to the assignee hereof. The disclosures of the prior Applications are considered part of and are incorporated by reference into this Patent Application.

FIELD

The present disclosure relates to positive displacement pumps, and in particular, to a safety deflector for the drive system of a linear frac pump.

BACKGROUND

Existing frac pumps use a chevron-style "packing seal" on a plunger to create a robust seal against the frac fluid or media being pumped at pressures of approximately 15,000-20,000 PSI. This frac media may be composed of water, sand, gel, acid, cement, and other chemicals typically used in well servicing and completion. This media is extremely harsh and even more so at the extreme pressures needed for fracking operations. Therefore, the plunger packing seal has a limited life that may expire during the service pumping operation while under high pressure. Upon failure of the packing seal, high-pressure streams of the harsh frac fluid would escape, with the potential to cause considerable damage to the pump.

DETAILED DESCRIPTION

A plunger packing seal may fail during service pumping operations. When this failure occurs, the high-pressure frac fluid escapes past the plunger. On traditional frac pumps the jet stream of fluid may impact the power end of the pump and potentially damage the pump. In a linear pump configuration, where the fluid end and the drive system are in linear alignment, the risk of damage to the power end due to a failure of the packing seal is even higher. The present disclosure describes a novel deflector structure situated between the fluid end and the drive system of the linear pump that eliminates a direct pathway for the jet stream of frac fluid to enter the drive system. In this way, even in the event of a packing seal failure at high pressure, the drive system is protected.

Figure 1:
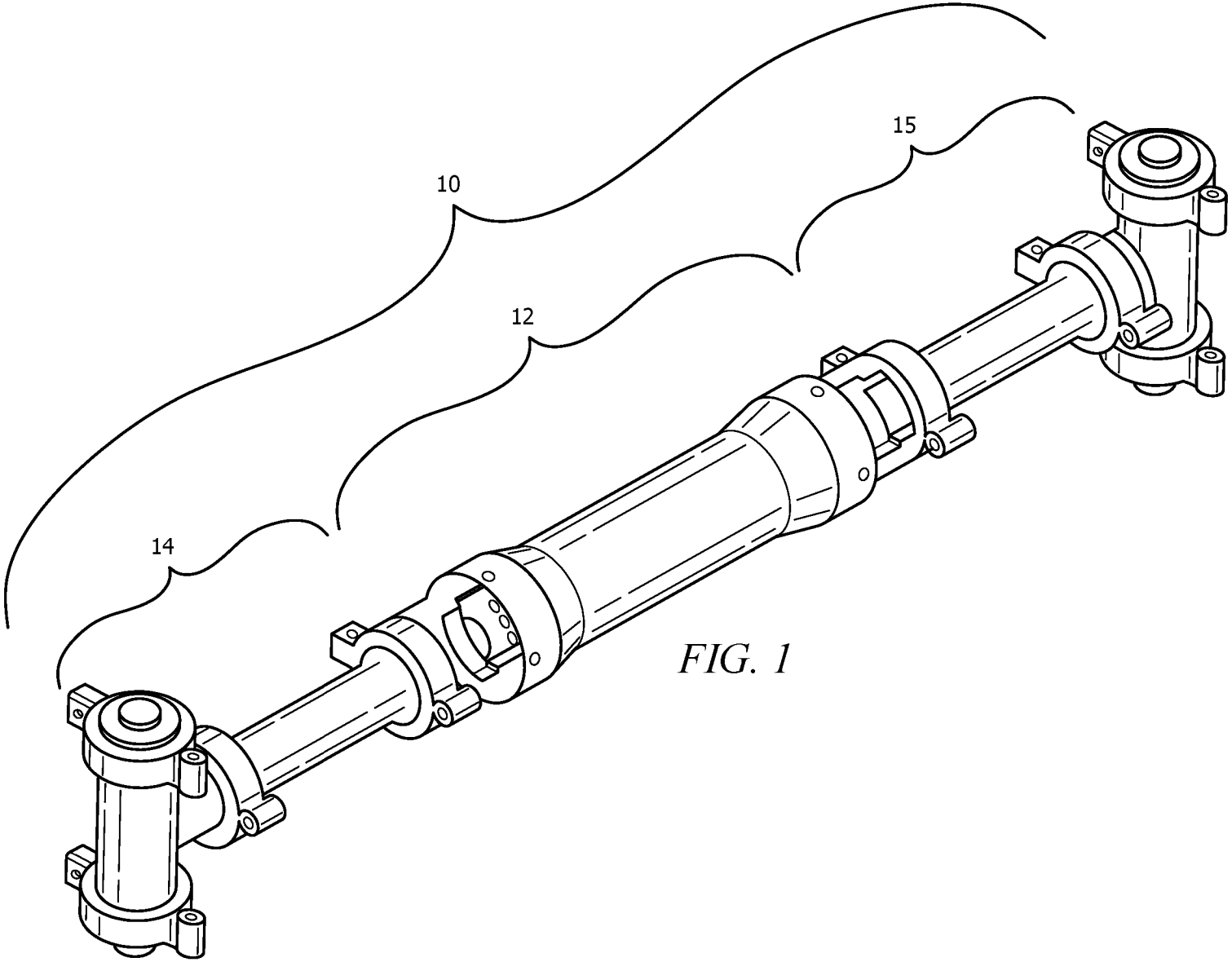
FIG. 1 is a perspective view of an embodiment of a linear pump according to the teachings of the present disclosure.
Figure 2:
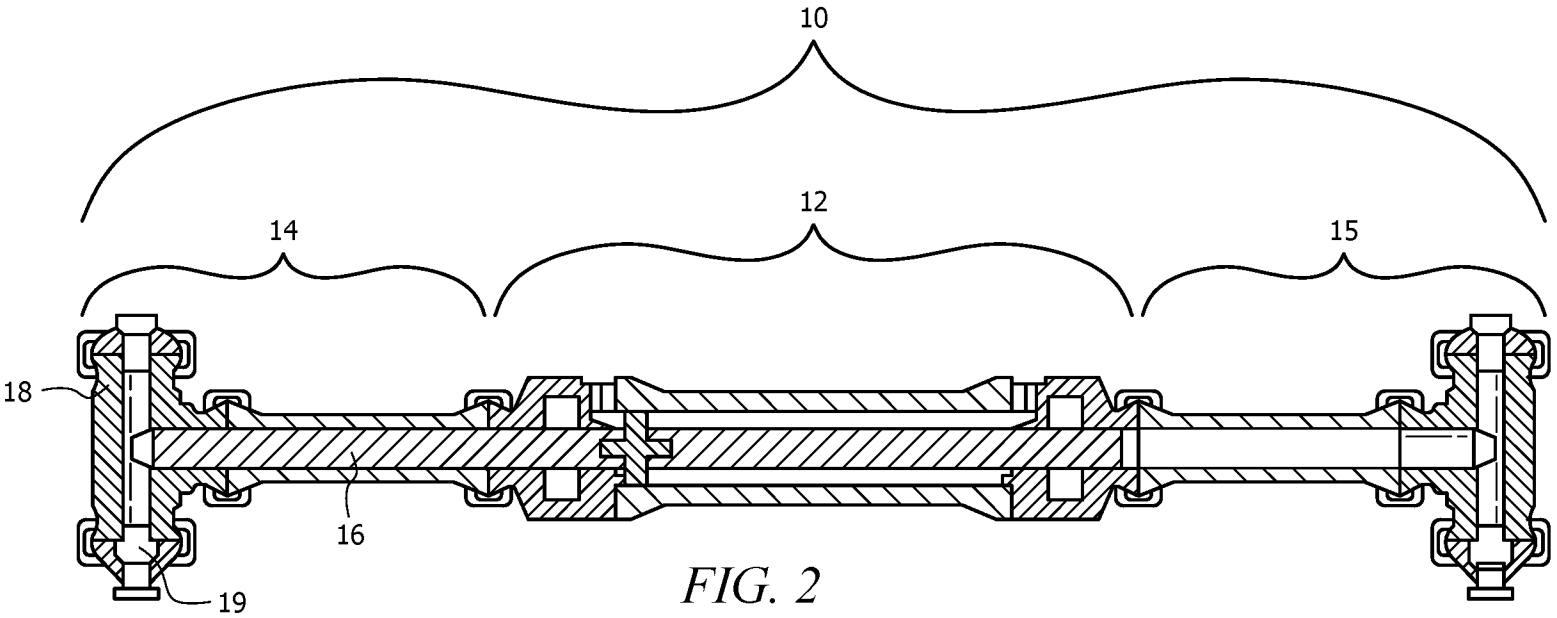
FIG. 2 is a cross-sectional view of an embodiment of a linear pump according to the teachings of the present disclosure.

In a double-action linear pump configuration 10 shown in FIGS. 1 and 2, the drive system 12 is disposed between two fluid ends 14 and 15. The drive system 12 actuates a plunger 16 with two ends that move the frac fluid in both fluid ends 14 and 15. The drive system 12 may be powered by natural gas electric generators, such as gas turbine generators and other types of generators, and an electric motor that powers a hydraulic system that drives the plunger. The fluid ends 14 and 15 each includes two or more valves 18 and 19, functioning as suction valve and discharge valve, that allow the frac fluid to be pumped in and out of the fluid end block by the linear actuation of the plunger.

Figure 3:
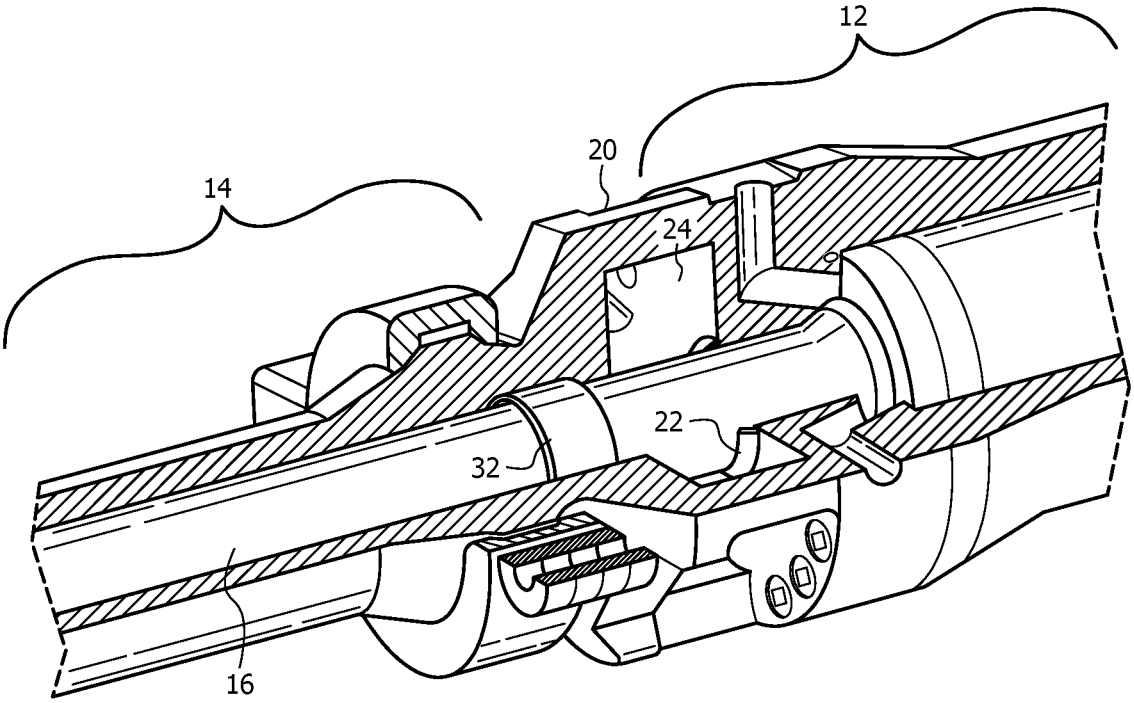
FIG. 3 is a more detailed partial cut-away view of an embodiment of the linear pump incorporating a drive system safety deflector according to the teachings of the present disclosure.
Figure 4:
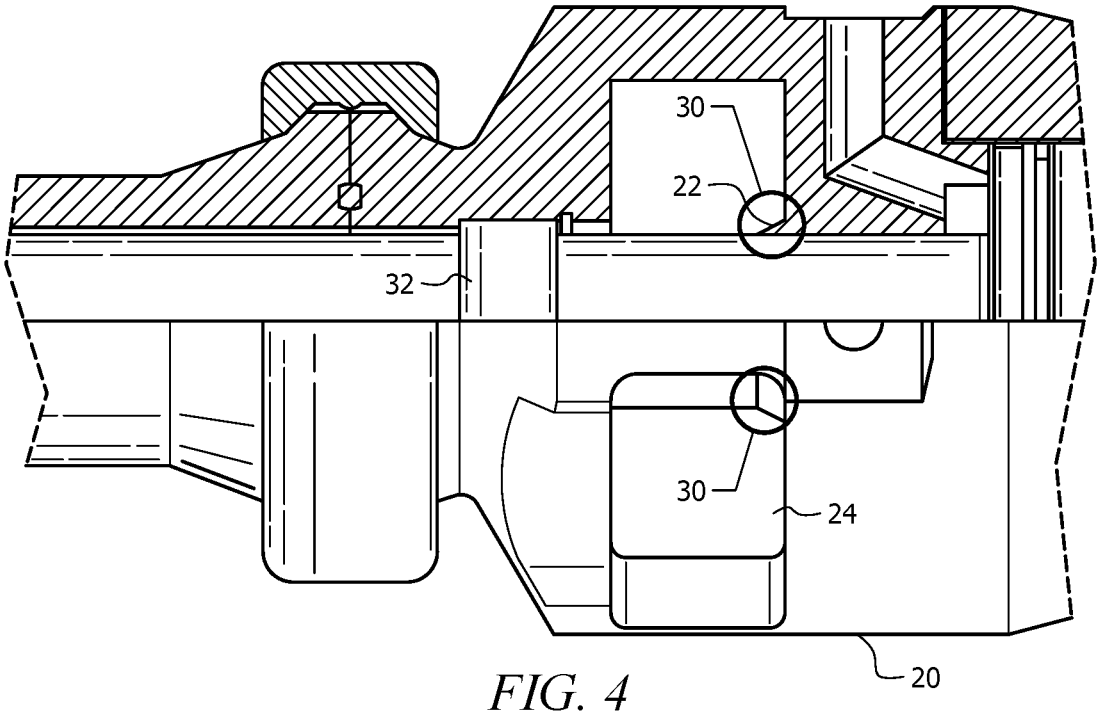
FIG. 4 is a more detailed partial cross-sectional view of the linear pump incorporating a drive system safety deflector according to the teachings of the present disclosure.

Referring to FIGS. 3 and 4, an adapter 20 is disposed at an interface between each fluid end and the drive system 12 (referring to fluid end 14 as shown but also applicable to fluid end 15). The adapter 20 is secured to both the drive system 12 and the fluid end 14 at an interface therebetween. The linear pump configuration 10 shown in FIGS. 1 and 2 includes an adapter 20 at both ends of the drive system 12 serving as the interface between the drive system 12 and the fluid ends 14 and 15. The adaptor 20 houses a deflector 22 that is situated within a void 24 within the adapter 20 that is open to the atmosphere outside of the pump 10. With reference also to FIG. 4, the deflector 22 incorporates an angled conical surface 30 that would function to deflect jets of fluid if high-pressure frac fluids escape past the packing seal 32 in the fluid end 14 toward the drive system 12. The angled conical surface 30 of the deflector 22 encircles the plunger 16 and is tapered away from the packing seal 32. The deflector 22 maintains close contact with the plunger 16 so that there is not a gap that would allow fluids to travel between the plunger 16 and the deflector 22 and reach the drive system 12. The angled conical surface 30 of the deflector 22 may be shaped to include one or more concave features to improve the sealing characteristics of the deflector 22 in the event of a packing seal failure. The deflected fluid spray is directed by the angled surface of the deflector 22 out of the adapter 20 and vented to the atmosphere. The deflector 22 may be fabricated of any suitable elastomer and/or metal materials.

It should be noted that although the illustrations herein show a double-action pump configuration, the deflector is equally applicable to a single action pump with a single fluid end.

The features of the present invention which are believed to be novel are set forth below with particularity in the appended claims. However, modifications, variations, and changes to the exemplary embodiments described above will be apparent to those skilled in the art, and the drive system safety deflector for a linear pump described herein thus encompasses such modifications, variations, and changes and are not limited to the specific embodiments described herein.

What is claimed is:

1. A reciprocating pump comprising:

a drive system having a first adapter coupled to a first end of the drive system and a second adapter coupled to a second end of the drive system;

a plunger having a center portion coupled to the drive system, and the plunger further having first and second end portions;

a first fluid end receiving the first end portion of the plunger, the first fluid end coupled to the first adapter;

a second fluid end receiving the second end portion of the plunger, the second fluid end coupled to the second adapter; and first and second packing seals each being disposed about the plunger to isolate fluids within the respective first and second fluid ends;

wherein the first adapter houses comprises an angled deflector formed from a portion of the first adapter, the angled deflector positioned within a void of the first adapter, the angled deflector positioned within the void nearer to the drive system than to the first fluid end, the angled deflector configured to sealingly engage a portion of the plunger and to deflect and redirect high-pressure fluids escaping past the first packing seal away from the drive system.

2. The pump of claim 1, wherein the angled deflector extends from an inner surface of the first adapter towards the first fluid end and into the void of the first adapter.

3. The pump of claim 1, wherein the angled deflector comprises a conical shape presenting an angled surface circumscribing the plunger.

4. The pump of claim 1, wherein the angled deflector comprises an annular body circumscribing the plunger with a surface contour configured to deflect escaped fluids away from the drive system.

5. The pump of claim 1, wherein the drive system is configured to actuate the plunger to cause a linear displacement of the plunger end portions to reciprocate within the first and second fluid ends of the pump.

6. A linearly-actuated pump comprising:

a plunger having a center portion and first and second end portions, the center portion being coupled to a drive system capable of effecting linear displacement of the plunger;

a first adapter coupled to a first end of the drive system and housing a first portion of the plunger;

a first fluid end receiving the first end portion of the plunger, the first fluid end coupled to the first adapter;

a second adapter coupled to a second end of the drive system and housing a second portion of the plunger;

a second fluid end receiving the second end portion of the plunger; and first and second packing seals each being disposed about the plunger to isolate fluids within the respective first and second fluid ends;

wherein at least one of the first adapter and the second adapter comprises an angled deflector formed from a portion of the respective adapter, the angled deflector sealingly encircling the plunger, the angled deflector contacting the plunger and having a conical surface extending from an inner diameter of the angled deflector and tapering away from the respective first or second packing seal, the deflector configured to deflect and redirect high-pressure fluids escaping past the respective packing seal away from the drive system.

7. The pump of claim 6, wherein the first and second adapters each comprises a void in fluid communication with an atmosphere external to the pump.

8. The pump of claim 6, wherein the angled deflector is a first angled deflector of the first adapter and the pump comprises a second angled deflector of the second adapter, each angled deflector comprising an angled surface configured to deflect fluids from the respective packing seal away from the drive system.

9. The pump of claim 6, wherein the drive system is configured to actuate the plunger to cause a linear displacement of the plunger end portions to reciprocate within the first and second fluid ends of the pump.

10. A pump comprising:

a plunger coupled to a drive system at a first end portion of the plunger;

a fluid end receiving a second end portion of the plunger;

a packing seal disposed about the plunger to isolate fluids within the fluid end;

an adapter disposed between the drive system and the fluid end and coupled to the drive system and to the fluid end; and an angled deflector formed from a portion of the adapter, the angled deflector having an inner diameter encircling at least a portion of the plunger and providing a seal against the plunger, the angled deflector configured to deflect and redirect high-pressure fluids escaping past the packing seal away from the drive system.

11. The pump of claim 10, wherein the adapter defines a void in fluid communication with an atmosphere external to the pump and the angled deflector is positioned within the void.

12. The pump of claim 10, wherein the angled deflector comprises a conical shape circumscribing the plunger.

13. The pump of claim 10, wherein the drive system is configured to actuate the plunger to cause a linear displacement of the plunger end portions to reciprocate within the fluid end of the pump.

14. The reciprocating pump of claim 1, wherein the second adapter incorporates a second angled deflector positioned within a void of the second adapter and configured to deflect and redirect high-pressure fluids escaping past the second packing seal toward the drive system.

15. The reciprocating pump of claim 1, wherein an angled portion of the angled deflector circumscribes the plunger.

16. The reciprocating pump of claim 1, wherein the angled deflector is formed as a portion of the first adapter and contacts a portion of the plunger.

17. The linearly-actuated pump of claim 6, wherein the angled deflector is formed as a portion of the first adapter.

18. The linearly-actuated pump of claim 6, wherein the angled deflector is positioned within a void defined by the respective first or second adapter and is positioned adjacent the drive system.

19. The pump of claim 10, wherein the angled deflector comprises an angled surface extending from the inner diameter of the angled deflector towards an outer diameter of the angled deflector.

20. The pump of claim 10, wherein the angled deflector comprises a concave surface.

* * * * *